US006095934A

United States Patent [19]

Ohama

[11] Patent Number: 6,095,934

[45] Date of Patent: Aug. 1, 2000

[54] MULTI-PURPOSE RETRACTABLE GOLF ACCESSORY

[76] Inventor: Marvin W. Ohama, 31 Chinook Way West, Brooks, Alberta, Canada, T1R 0C6

[21] Appl. No.: 09/181,018

[22] Filed: Oct. 27, 1998

[51] Int. Cl.[7] ..... A63B 57/00

[52] U.S. Cl. ..... 473/408; 473/406; 473/407; 224/918

[58] Field of Search ..... 473/406, 407, 473/408, 284, 285, 286; 224/918

[56] References Cited

U.S. PATENT DOCUMENTS

| | | | |
|---|---|---|---|
| D. 328,117 | 7/1992 | Haugom . | |
| D. 391,318 | 2/1998 | Shah . | |
| 3,233,802 | 2/1966 | Ludwick | 473/406 |
| 3,298,579 | 1/1967 | Smith | 224/918 |
| 4,239,216 | 12/1980 | Bauer | 473/286 |
| 4,386,774 | 6/1983 | Buckman . | |
| 4,645,105 | 2/1987 | Plumbridge | 224/918 |
| 4,960,278 | 10/1990 | Hainey | 473/407 |
| 4,998,726 | 3/1991 | Budnick . | |
| 5,054,777 | 10/1991 | Borden . | |
| 5,110,123 | 5/1992 | Larson . | |
| 5,226,647 | 7/1993 | Notarmuzi . | |
| 5,292,120 | 3/1994 | Pehoski . | |
| 5,401,019 | 3/1995 | Wissman . | |
| 5,405,133 | 4/1995 | Upton . | |
| 5,419,551 | 5/1995 | Hoyt . | |
| 5,449,169 | 9/1995 | Hardin . | |
| 5,562,553 | 10/1996 | Digerness . | |
| 5,799,853 | 9/1998 | Brewster | 224/918 |

*Primary Examiner*—Steven Wong
*Attorney, Agent, or Firm*—Edward A. McConwell, Jr.; McConwell Law Offices

[57] ABSTRACT

A multi-purpose golf accessory including a housing that allows a golfer to use a variety of golf tools through extension and retraction of the tools relative to the housing. The housing comprises a rear section attached to a front section. The rear section includes a belt clip. The front section defines a channel and includes a recessed magnetic surface within the channel for receiving and holding a metal ball marker therein. A reel is pivotally mounted about a shaft within the housing and includes a semi-flexible cord coiled about the reel and movable between retracted and extended positions. One end of the cord extends through the lower end of the housing to hold a golf tool. A spring is mounted about the shaft for biasing the cord toward the retracted position. As a result, a golfer may selectively extend the cord for using the tool a desired distance away from the housing. When the golf tool is released following use, the spring causes the cord to be recoiled about the reel and the tool is returned to a position adjacent the housing.

15 Claims, 8 Drawing Sheets

MULTI-PURPOSE RETRACTABLE GOLF ACCESSORY

BACKGROUND OF THE INVENTION

The present invention relates to a golf accessory and, more particularly, to a multi-purpose golf accessory which is retractable to a housing attached to a golfer's belt.

Several golf accessories are essential to the sport of golf. Particularly, accessories such as ball markers and divot repair tools enable a golfer to abide by the rules and etiquette of the game. Other accessories such as a brush or cleaning tool are often needed to clean a golf club, putter, or the ball. A golfer typically carries each of these individual accessories in his pocket or golf bag and must repetitively locate and retrieve the appropriate accessory during game play.

Various devices have been proposed which combine one or more of these accessories into a single accessory. Although assumably effective to maintain multiple accessories in one location, such devices still must be repetitively stored and retrieved each time an accessory is needed.

It is therefore desirable to have a multi-purpose golf accessory which can remain attached to a golfer's belt or golf bag even while using various accessories thereof. It is further desirable that multiple golf accessories can be extended from a housing attached to a golfer's belt and then retracted thereto following use.

SUMMARY OF THE INVENTION

A multi-purpose golf accessory constructed in accordance with the present invention utilizes a housing that can be clipped to a golfer's belt or golf bag for holding a variety of golf tools and accessories in a single, convenient location. Golf tees, for example may be insertably held by the housing. A front section of the housing includes a recessed surface bounded by laterally opposed slots for receiving a ball marker therein. The surface is magnetic for retaining a metallic ball marker for selective removal by the golfer.

Within the housing, a shaft is attached to the inner wall of the front section and extends through a reel pivotally attached thereto. One end of a semi-flexible cord is attached to the reel and can be coiled or uncoiled thereabout. An opposed end of the cord is attached to a D-ring which extends below the housing to pivotally hold a variety of golf tools. One end of a coil spring is attached to the shaft while the opposing end is attached to the reel. Thus, as the cord is extended or uncoiled from the reel by a user, the spring is wound more tightly about the shaft. When the cord is released, the cord is again coiled about the reel as the spring is allowed to unwind.

A divot repair tool having a fork-like pair of prongs for repairing divots or ball marks on a golf green is pivotally coupled to the D-ring. Similarly, a cleaning tool having a brush and pointed blade for cleaning golf club heads or the ball is also pivotally coupled to the D-ring. The cleaning tool includes a recess into which the divot tool can be frictionally stored when not in use. In use, a golfer can extend the divot or cleaning tool to a desired usable position through an uncoiling of the cord from the reel. When the tools are released following use, the cord is recoiled about the reel as the spring is allowed to unwind. Thus, the tools are returned to a position immediately adjacent the housing.

It is therefore a general object of the invention to provide a golf accessory which contains several golf items and is attachable to a golfer's belt or golf bag.

Another object of the invention is to provide a golf accessory, as aforesaid, which magnetically holds a ball marker when not in use.

Still another object of the invention is to provide a golf accessory, as aforesaid, which contains a divot repair tool for repairing divots and ball marks on a golf green.

Yet another object of the invention is to provide a golf accessory, as aforesaid, which contains a blade for cleaning golf cleats or club heads.

A further object of the invention is to provide a golf accessory, as aforesaid, which contains a brush for cleaning club heads or golf balls.

A particular object of the invention is to provide a golf accessory, as aforesaid, having a retractable cord whereby the golf tools can be extended from a housing during use and retracted thereto after use such that the accessory need not be removed from the golfer's belt or bag during use.

Another object of the invention is to provide a golf accessory, as aforesaid, the housing having a recess into which the extendable golf items are secured against substantial movement following retraction.

Other objects and advantages of the invention will become apparent from the following description taken in connection with the accompanying drawings, wherein is set forth by way of illustration and example, an embodiment of this invention.

DESCRIPTION OF THE PREFERRED EMBODIMENT

Figure 1:
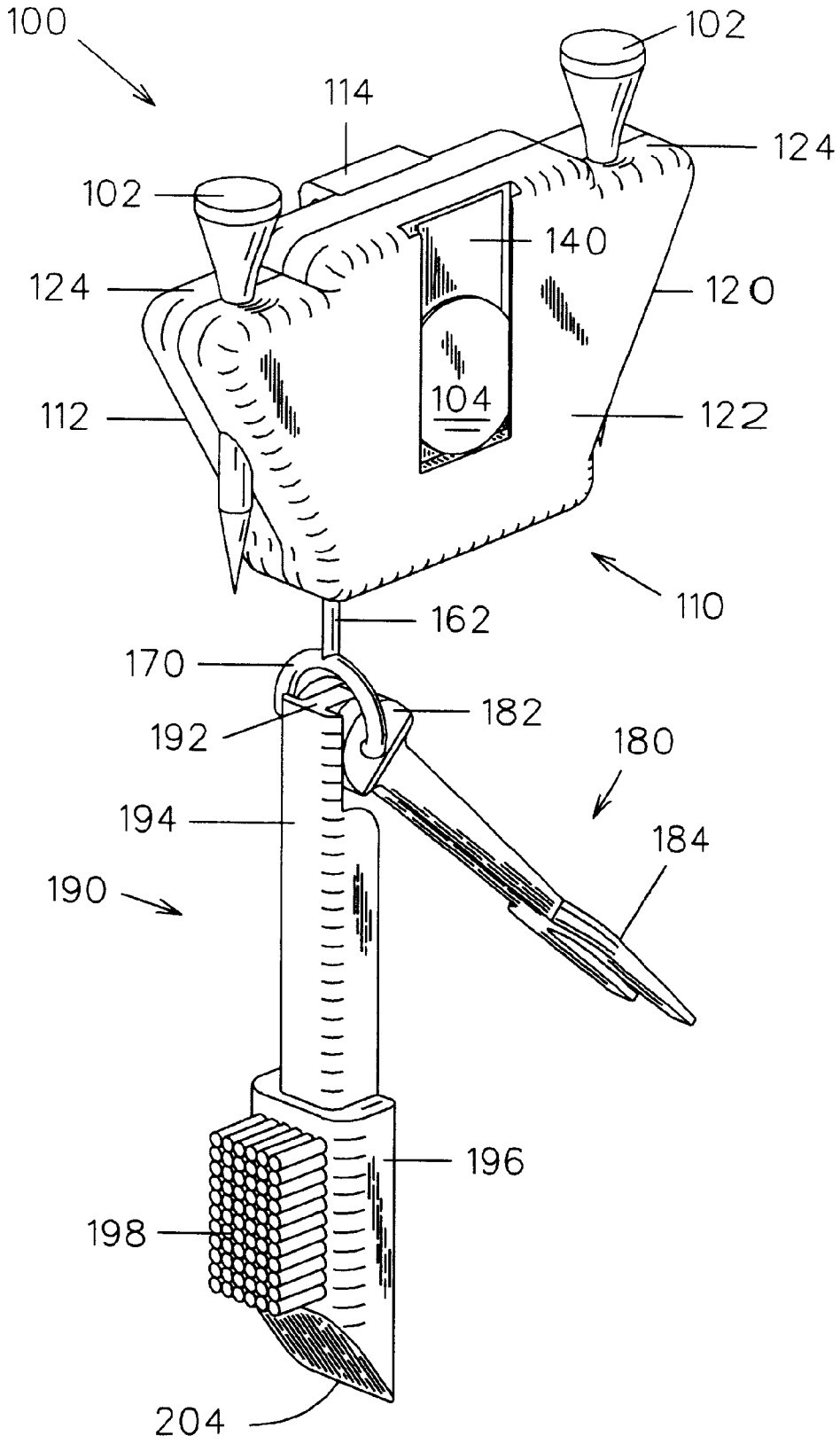
FIG. 1 is a perspective view of a golf accessory constructed in accordance with a preferred embodiment of the present invention having a brush and divot tool in a partially extended position.
Figure 2:
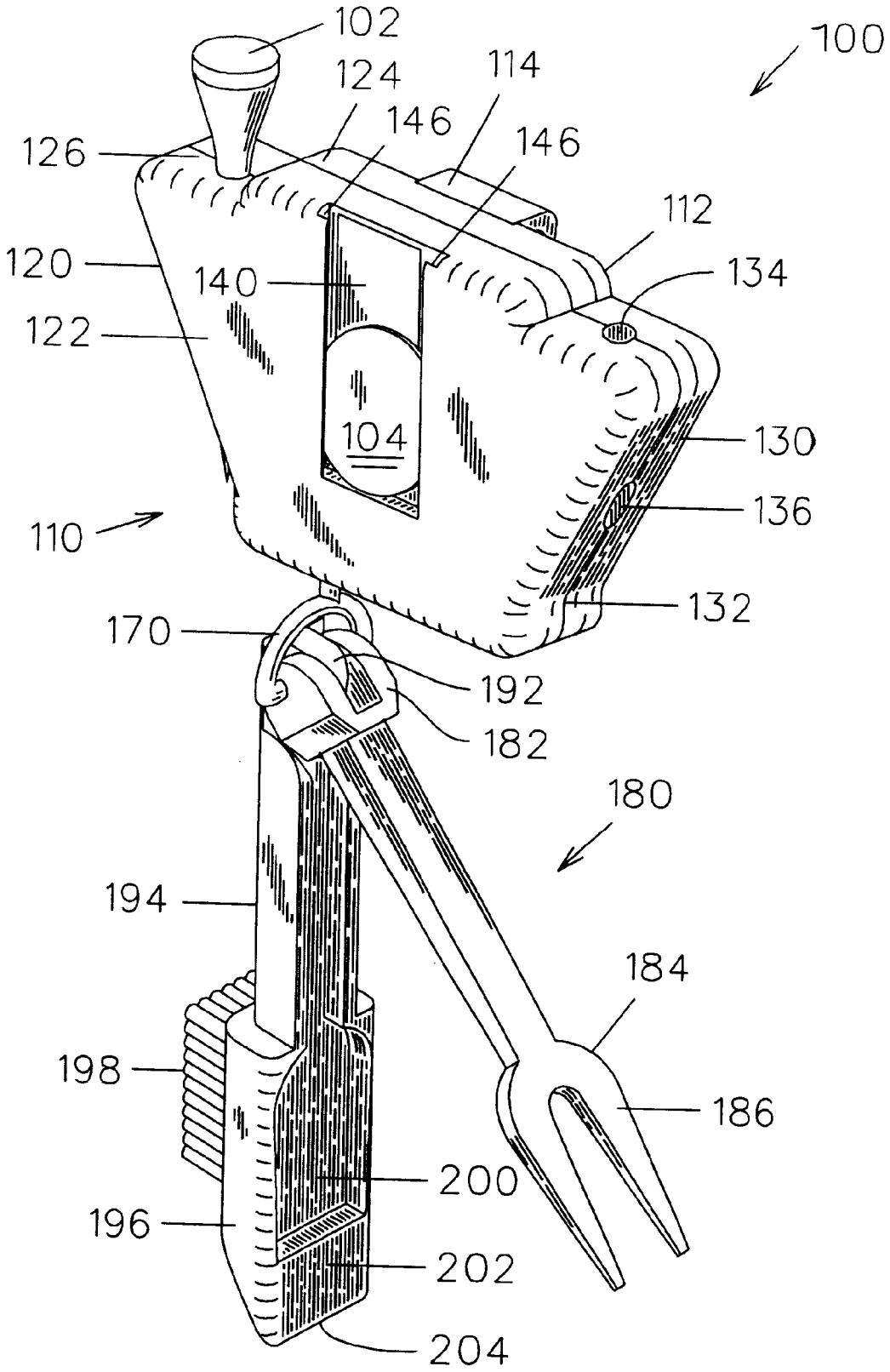
FIG. 2 is a right side perspective view of the golf accessory of FIG. 1 with a golf tee removed from the housing.
Figure 3:
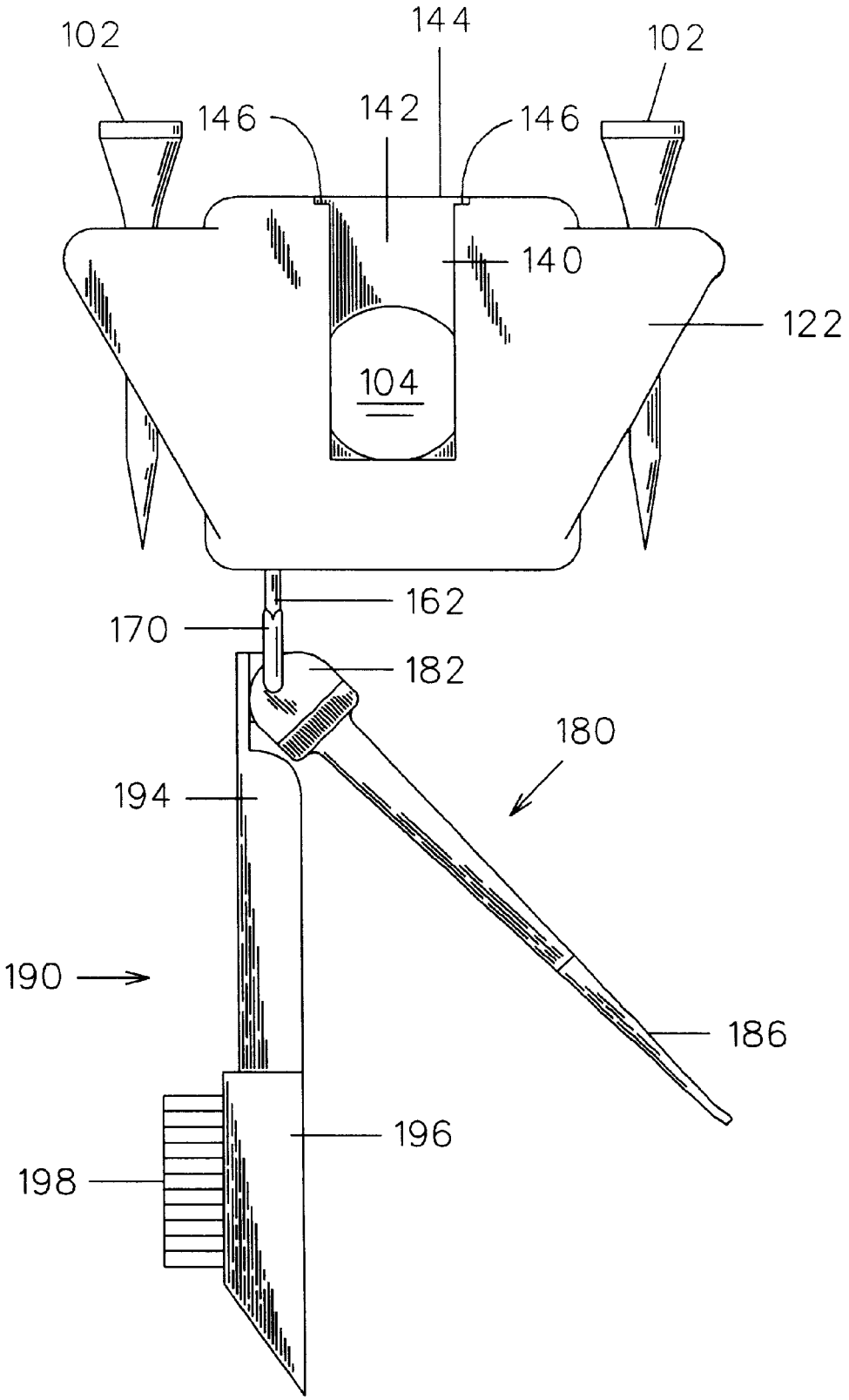
FIG. 3 is a front view of the golf accessory of FIG. 1.

A golf accessory 100 constructed in accordance with a preferred embodiment of the present invention is shown in FIGS. 1 and 2. The accessory 100 includes a housing 110 for holding multiple golf items, examples of which are described below. Preferably, the housing 110 is molded from a lightweight, rigid material such as polyvinyl plastic, although metal, or any other suitable material may also be used.

Figure 4A:
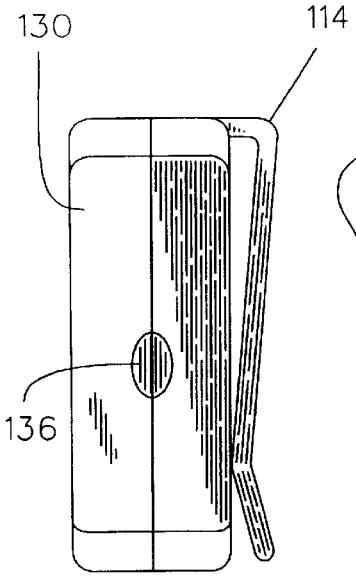
FIG. 4A is an enlarged right side view of the housing of the golf accessory of FIG. 1.
Figure 4B:
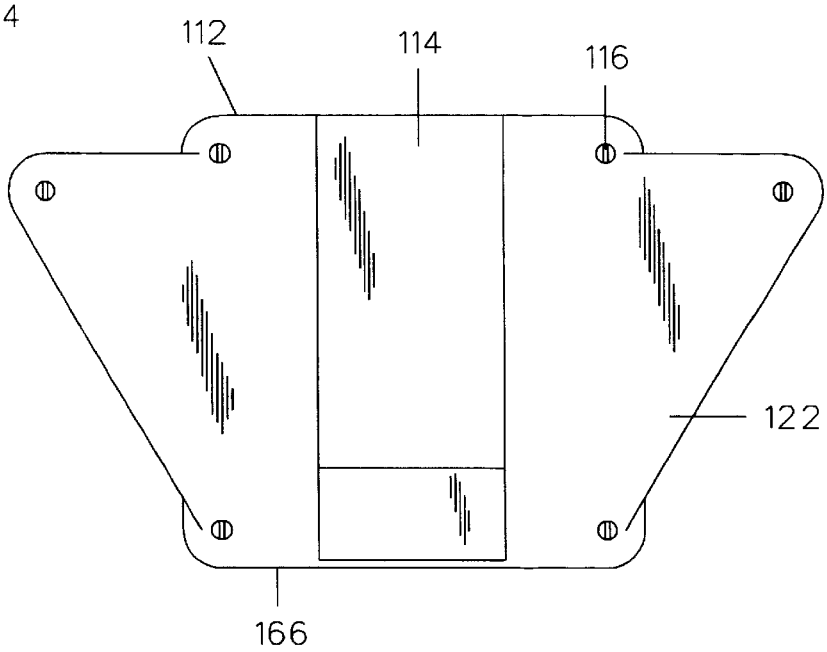
FIG. 4B is an enlarged rear view of the housing of the golf accessory of FIG. 1.

The housing 110 comprises a rear section 112 attached to a front section 120 by screws 116 (FIGS. 4B and 5), both sections 112, 120 having an identical exterior configuration.

Each section 112, 120 includes an outer wall 122 normal to inwardly extending upper 124 and lower 166 ends with sides 130 extending therebetween. The sides 130 slope inwardly between the upper 124 and lower 166 ends such that the upper end is of greater length than the lower end. A chamber is formed between the front 120 and rear 112 sections for housing moving parts of the accessory 100.

Figure 5:
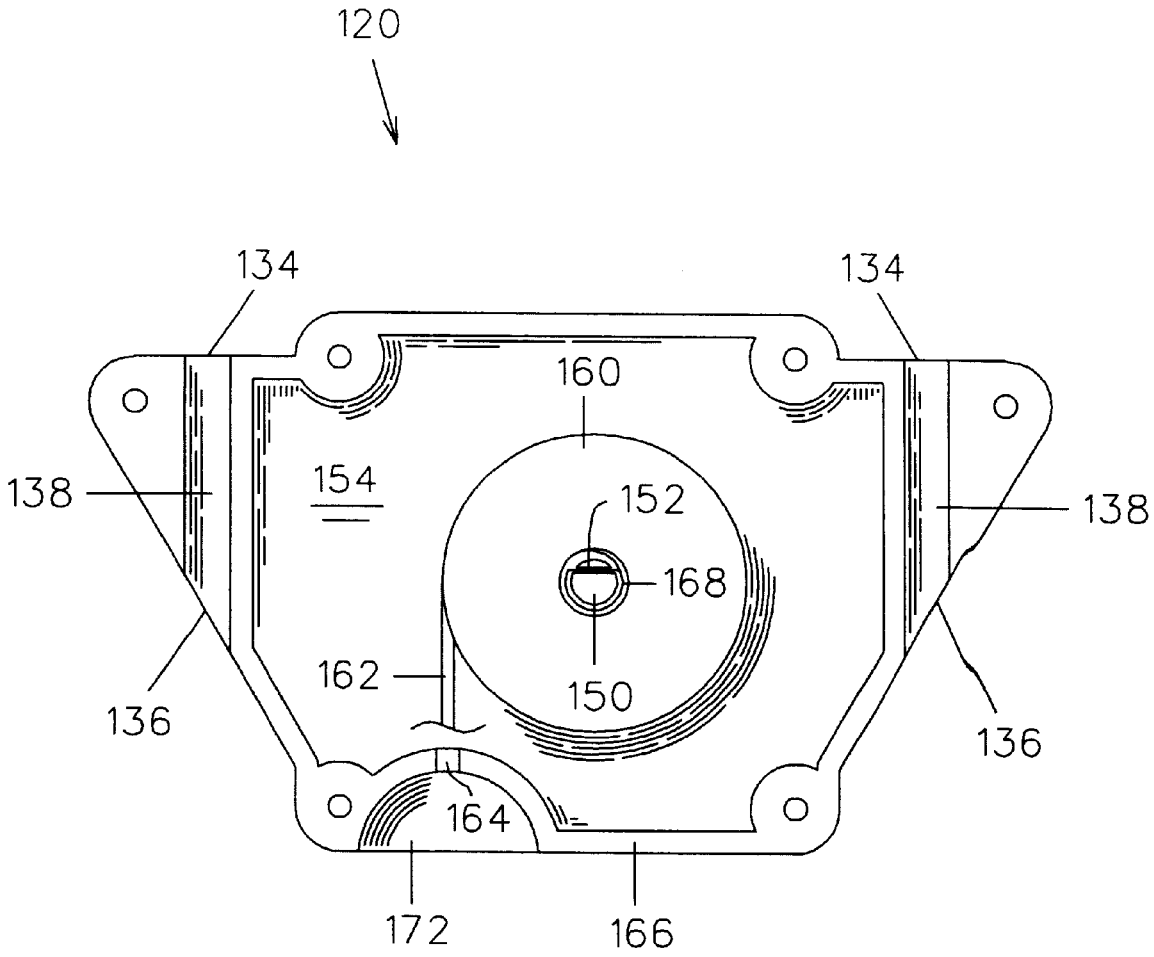
FIG. 5 is an enlarged front view of the housing of the golf accessory with the front panel removed.
Figure 6A:
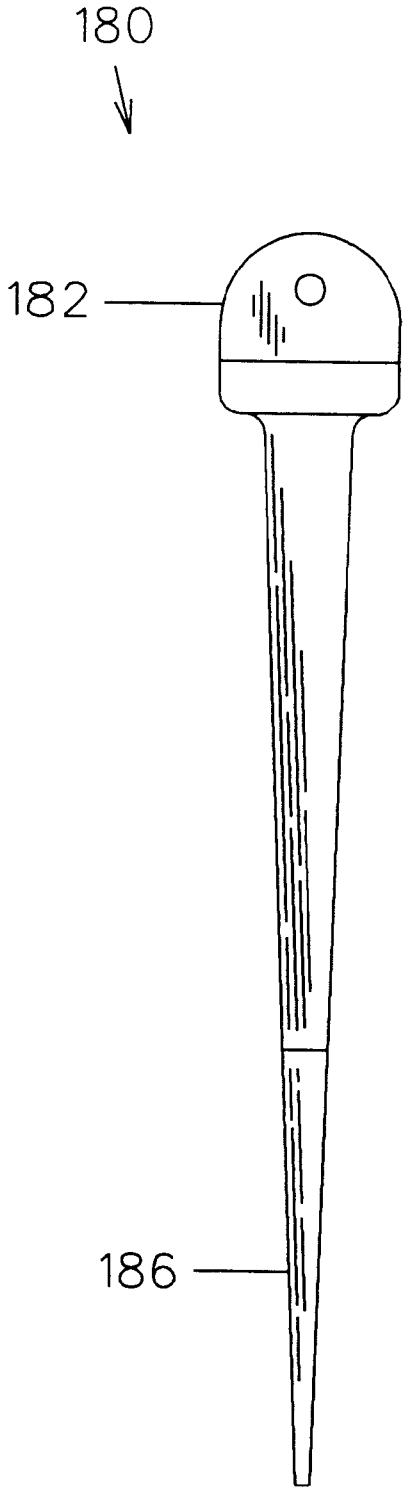
FIG. 6A is a left side view of the divot repair tool of the golf accessory of FIG. 2.
Figure 6B:
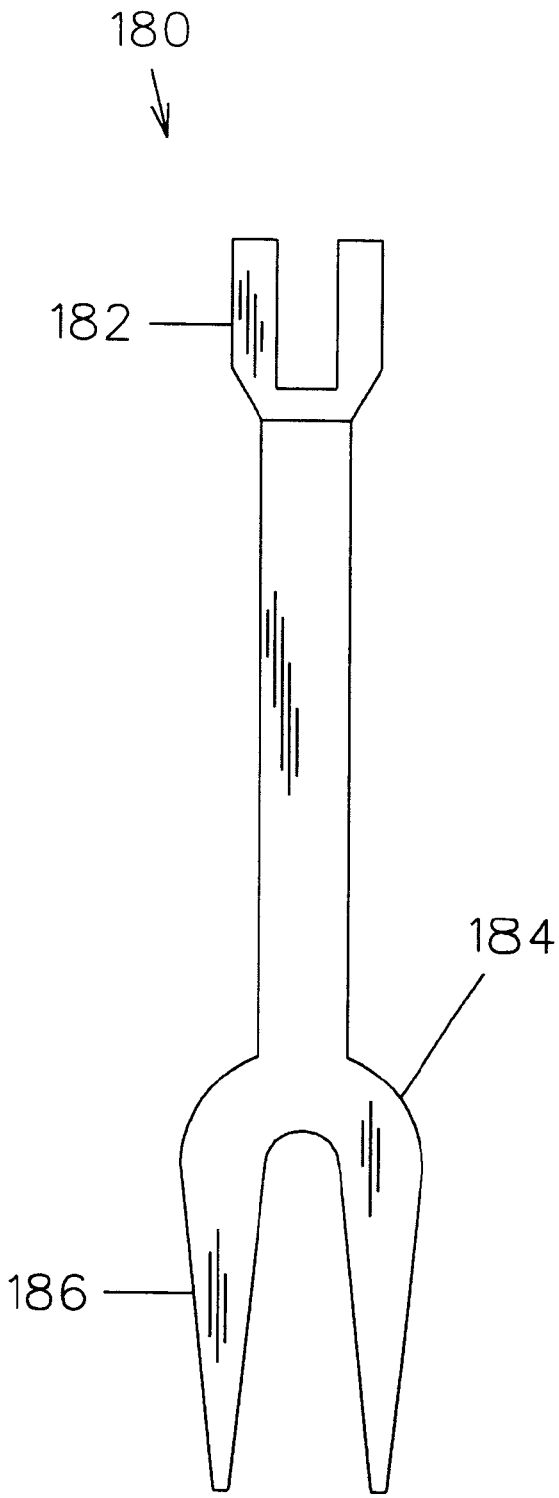
FIG. 6B is a front view of the divot repair tool of the golf accessory of FIG. 2.

As shown in FIGS. 2 and 5, the peripheral edges 126, 132 of the upper ends 124 and the sides 130, respectively, of the housing 110 define upper 134 and lower 136 apertures at the juncture between the front 120 and rear 112 sections, and a bore 138 in communication with the apertures 134, 136 through which golf tees 102 may be inserted through the housing 110. In addition, a belt clip 114 is attached to the outer wall 122 of the rear section 112 of the housing 110 such that the accessory can be attached to a golfer's belt or golf bag.

The outer wall 122 of the front section 120 defines a channel 142 having an open upper end 144 and a pair of laterally opposed slots 146. It will be appreciated that a ball marker 104 may be slidably received in the channel 142 and retained by the opposed slots 146. The wall 122 also includes an insert presenting a recessed surface 140 generally spanning the length and width of the channel 142. The recessed surface 140 is preferably formed of a magnetic material suitable for securely holding a metallic ball marker 104 therein until selectively removed by the golfer.

With reference being made to FIG. 5, a shaft 150 is fixedly attached to the inner wall 154 of the front section 120 of the housing 110. The shaft 150 extends through the center of a reel 160 which is pivotally mounted thereto for coiling or uncoiling a cord 162 between retracted and extended positions. The cord 162 is preferably made of a semi-flexible material such as nylon. The cord 162 extends through an aperture 164 defined in the lower end 166 of the housing 110 and is attached to a variety of golf tools held below the housing 110, described more fully below. One end of a coil spring 168 is fixedly attached to the reel 160 while the opposed free end thereof engages a slot 152 in the shaft 150. As a result, the cord 162 is biased toward the retracted position.

One end of the cord 162 extends below the housing 110 and is fixedly attached to a D-ring 170 for holding a variety of golf tools therebelow (FIGS. 1 and 2). When the reel 160 and cord 162 are in the retracted position, the D-ring 170 is held tightly within a cavity 172 defined in the lower end 166 of the housing 110 to inhibit substantial movement of the golf tools held therebelow.

The golf accessory 100 includes a divot repair tool 180 useful for repairing divots or ball marks caused by approach shots to a golf green (FIGS. 1 and 2). The divot tool 180 includes a U-shaped coupling 182 integrally attached to a fork 184 having two relatively sharp prongs 186. The linear portion of the D-ring 170 extends through coupling 182, thus pivotally attaching the divot tool 180 thereto.

Figure 7A:
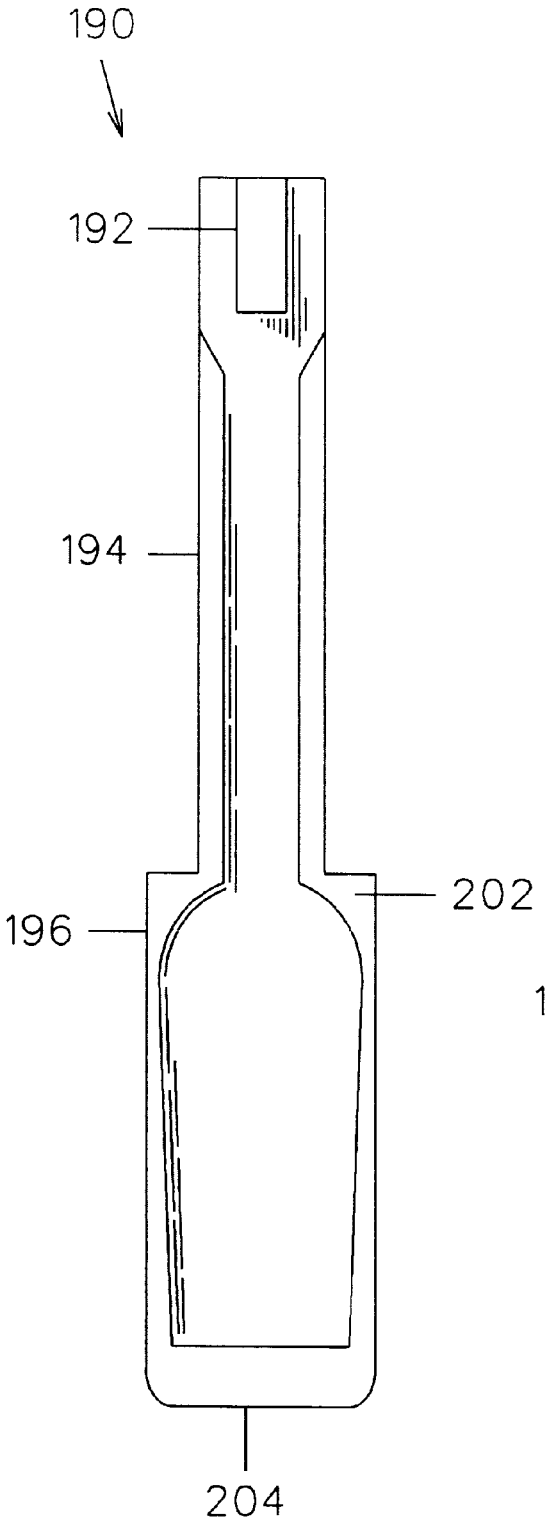
FIG. 7A is a rear view of the cleaning tool of the golf accessory of FIG. 1.
Figure 7B:
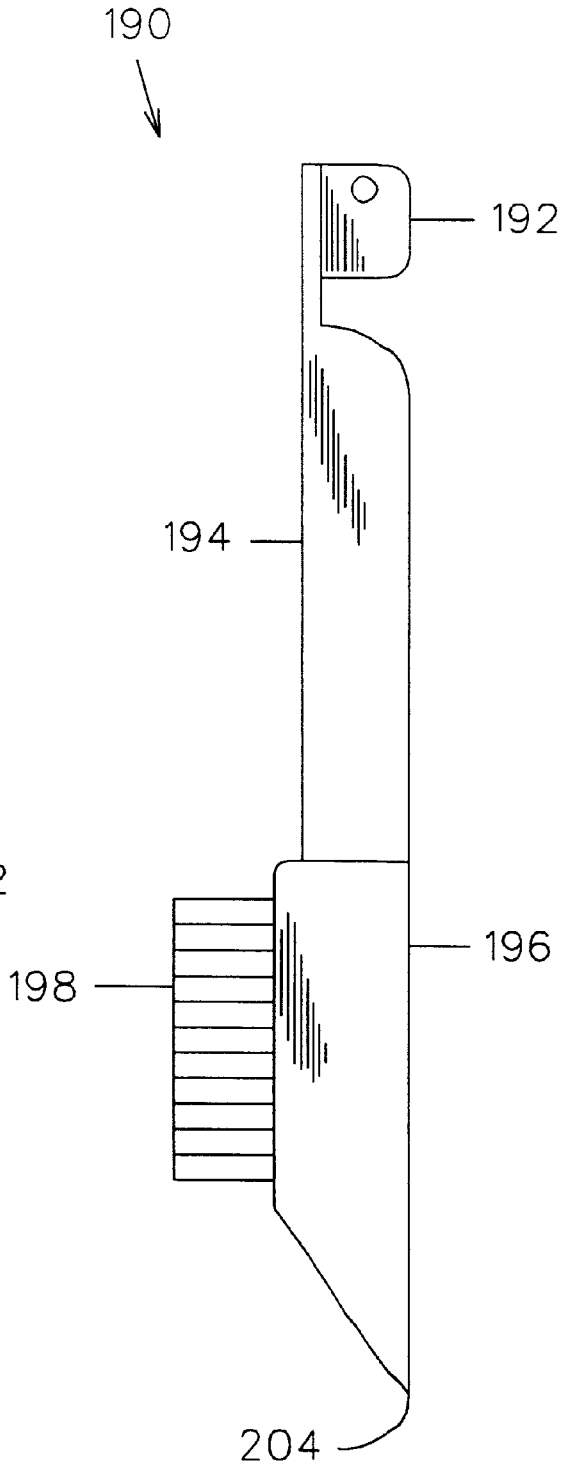
FIG. 7B is a left side view of the cleaning tool of the golf accessory of FIG. 1.
Figure 8:
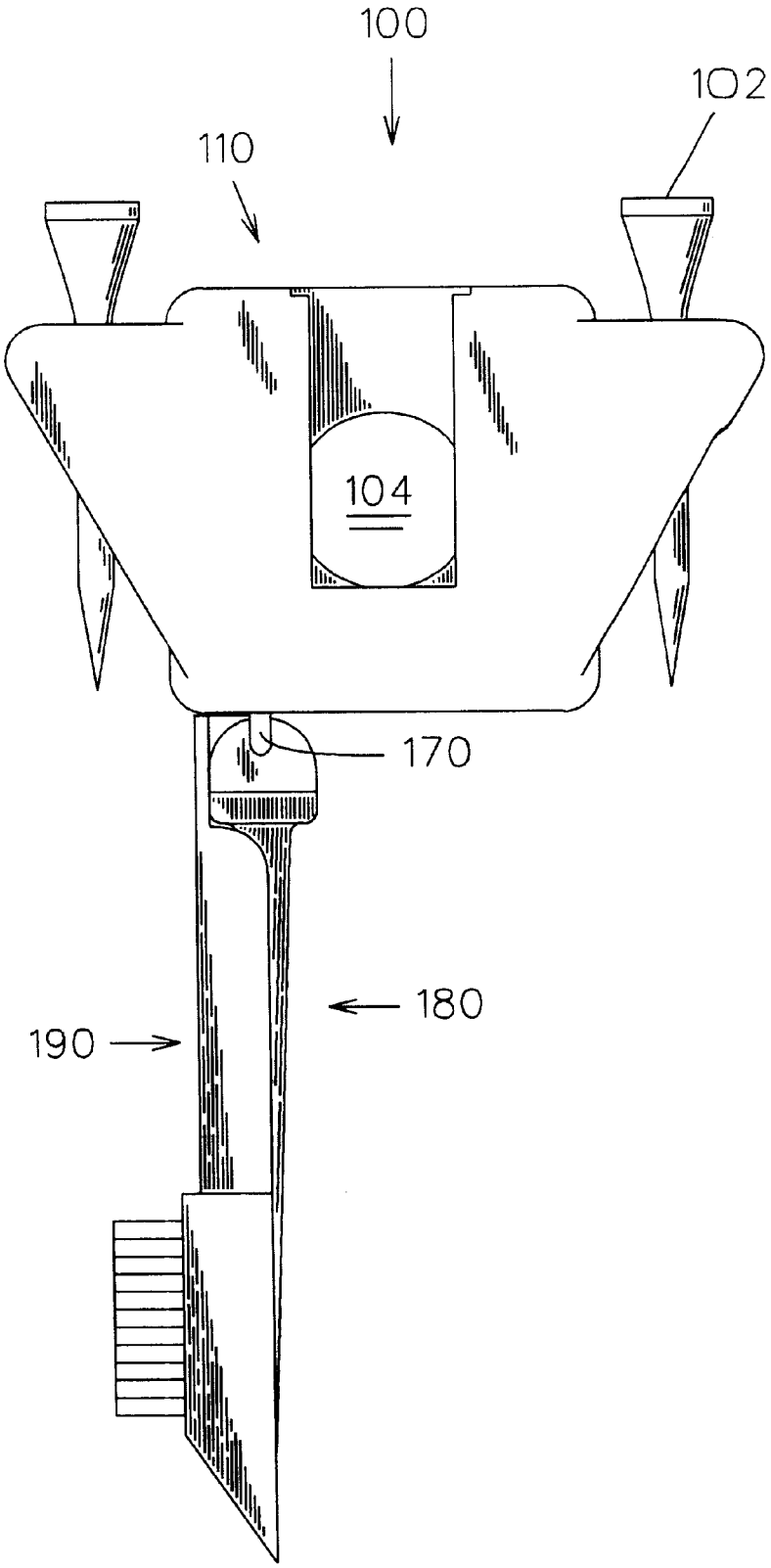
FIG. 8 is a front view of the golf accessory in a fully retracted configuration.

The golf accessory further includes a cleaning tool 190 for cleaning dirt from a golfing device, such as a golf club or ball. The cleaning tool 190 comprises a T-shaped coupling 192 integrally attached to a handle portion 194 (FIGS. 1 and 2). The handle portion 194 is integrally attached to a head portion 196 having a brush 198 extending from one side thereof (FIG. 7B). The linear portion of the D-ring 170 also extends through coupling 192, for pivotally attaching the cleaning tool 190 to the D-ring 170. It is understood that the couplings 182, 192 are attached to the D-ring 170 such that the cleaning tool 190 and divot tool 180 are independently pivotal thereon as in FIG. 2. When not in use, the divot tool 180 can be held in a recess 200 formed in the back side 202 of the cleaning tool 190, the recess having a similar configuration as that of the divot tool 180 but with a slightly smaller dimension which enables a friction fit relationship therebetween (FIGS. 2, 7A, and 8). The head portion 196 of the cleaning tool 190 further includes a pointed blade 204 for scraping dirt and grass from the grooves of a club head.

As the cord 162 is uncoiled from the reel 160, such as by a user extending the divot and cleaning tools to a usable, extended position, the reel 160 is rotated about the shaft 150. Rotation of the reel 160 causes the spring 168 to be more tightly wound about the shaft 150. The cord 162 is thus spring biased toward the retracted position. As a result, the reel 160 and spring 168 cooperably provide a retracting means for retracting a substantial portion of the cord 162 within the housing 110. Alternatively, a crank or other device could be coupled with the reel 160 to provide a manual means for rotating the reel 160.

Accordingly, the multi-purpose retractable golf accessory 100 combines multiple golf accessories into a single device which can be maintained in a single, convenient location such as clipped to a golfer's belt or golf bag. In addition, each of the accessories can be used by extending the accessory to the desired point of use and then allowing it to retract to a housing following use.

It is understood that while certain forms of the invention have been illustrated and described, it is not limited thereto except insofar as such limitations are included in the following claims and allowable functional equivalents thereof.

What is claimed is:

1. A golf accessory comprising:

a housing defining an interior space and having a shaft positioned within the interior space, the housing presenting an upper end and defining an aperture in the upper end and a bore in communication with the aperture for receiving a golf tee;

a reel rotatably mounted on the shaft; a cord coupled with the reel and having a free end and depending from the housing;

a golf tool coupled with the free end of the cord; and retracting means for retracting a substantial portion of the cord within the interior space of the housing.

2. A golf accessory as claimed in claim 1 wherein said golf tool includes a ground repair device presenting a fork having a pair of prongs.

3. A golf accessory as claimed in claim 1 wherein said golf tool further includes a cleaning device having:

a handle member;

a head member attached to said handle member having a front side and a back side;

a brush attached to said front side; and a recess formed in said back side for receiving said ground repair device.

4. A golf accessory as claimed in claim 1, the housing presenting an outer wall, the accessory further including retaining means for retaining a ball marker to the housing including a channel defined in the outer wall having an open upper end and a pair of laterally opposed slots.

5. A golf accessory as claimed in claim 4, the retracting means further including an insert positioned in the channel, the insert presenting a surface constructed from a magnetic material.

6. A golf accessory as claimed in claim 1 wherein said retaining means comprises a coil spring having a first end attached to said shaft and a second end attached to said reel whereby an extension of said cord by a user from a first, retracted position to a second, extended position causes said spring to be wound about said shaft, said spring being restored to an unwound position upon release of said cord by the user.

7. A golf accessory as claimed in claim 1 further comprising a belt clip attached to said housing.

8. A multi-purpose golf accessory, comprising:

a two-piece housing having a front section fastened to a rear section, said sections having recesses configured to receive at least one golf tee therein;

a reel pivotally mounted about a shaft within said housing;

means for retaining a ball marker to said housing;

a cord having a first end attached to said reel and being coiled thereabout, said cord having a second opposed end extending below said housing;

means for repairing divots and ball marks on a golf green coupled to said second end of said cord;

means for cleaning a golfing device coupled to said second end of said cord; and a coil spring having a first end attached to said shaft and a second end attached to said reel whereby an extension of said cord by a user from a first position wherein said repairing and cleaning means are adjacent said housing to a second position wherein said repairing and cleaning means are displaced from said housing causes said spring to be wound about said shaft, said spring being restored to an unwound position with said cord being restored to said first position upon release of said cord by the user.

9. A golf accessory as claimed in claim 8 wherein said repairing means includes a fork having a pair of prongs suitable for extension into the ground.

10. A golf accessory as claimed in claim 8 wherein said cleaning means includes:

a handle member;

a head member attached to said handle member having a front side and a back side;

a brush attached to said front side; and a recess formed in said back side for receiving said repairing means therein.

11. A golf accessory as claimed in claim 8 wherein said retaining means includes a magnetic surface recessed into said outer surface of said front section of said housing, said surface having spaced apart slots adapted to receive a metal ball marker therein.

12. A golf accessory as claimed in claim 8 further includes a belt clip fixedly attached to said rear section of said housing whereby to releasably secure said housing to a user's belt or golf bag.

13. A golf accessory as claimed in claim 8 wherein said housing further includes a cavity in a lower end whereby to substantially preclude movement of said repairing and said cleaning means when in said first position.

14. A golf accessory adapted for retaining a metallic golf ball marker, the accessory comprising a housing defining an interior space and having a shaft positioned within the interior space, the housing presenting an outer wall defining a channel having an open upper end and a pair of laterally opposed slots, and including an insert positioned in the channel, the insert having a magnetic surface whereby a metallic golf ball marker may be retained when inserted in the channel by the opposed slots and the magnetic surface, the accessory further including:

a reel rotatably mounted on the shaft;

a cord coupled with the reel having a free end and depending from the housing;

a golf tool coupled with the free end of the cord; and a retracting means for retracting a substantial portion of the cord within the interior space of the housing.

15. A golf accessory as set forth in claim 14, the housing further presenting an upper end and defining an aperture in the upper end and a bore in communication with the aperture for receiving a golf tee.

* * * * *